US007901369B2

(12) United States Patent
Quinn et al.

(10) Patent No.: US 7,901,369 B2
(45) Date of Patent: Mar. 8, 2011

(54) MASSAGE TOOL AND METHOD FOR TREATMENT OF TRIGGER POINTS AND OTHER SOFT TISSUE DISORDERS

(76) Inventors: Rebecca E. Quinn, Huntsville, AL (US); William E. Gibson, Trinity, AL (US)

( * ) Notice: Subject to any disclaimer, the term of this patent is extended or adjusted under 35 U.S.C. 154(b) by 1073 days.

(21) Appl. No.: 11/487,247

(22) Filed: Jul. 14, 2006

(65) Prior Publication Data

US 2008/0015474 A1 Jan. 17, 2008

(51) Int. Cl.
*A61H 7/00* (2006.01)

(52) U.S. Cl. ..... 601/6; 601/135; 606/204

(58) Field of Classification Search ..... 601/6, 7, 601/11, 14, 134, 135; 604/313–316; 606/201–204
See application file for complete search history.

(56) References Cited

U.S. PATENT DOCUMENTS 714,342 A 11/1902 Watson
1,179,129 A 4/1916 Maxam
1,212,845 A * 1/1917 Talley ..... 601/6
1,864,700 A * 6/1932 Wade ..... 604/314
2,176,366 A 10/1939 Smith
3,841,322 A 10/1974 Spelio
4,428,368 A 1/1984 Torii
4,883,047 A 11/1989 Guitay
5,113,847 A 5/1992 Holzworth
5,228,431 A 7/1993 Giarretto
D403,075 S 12/1998 Lie
5,871,456 A * 2/1999 Armstrong et al. ..... 601/14
6,196,982 B1 3/2001 Ball
2004/0077977 A1 4/2004 Ella et al.

* cited by examiner

*Primary Examiner* — Quang D Thanh
(74) *Attorney, Agent, or Firm* — Angela Holt; Lanier Ford Shaver & Payne P.C.

(57) ABSTRACT

A massage tool and method for the treatment of trigger points and other soft tissue disorders on the human body is claimed. The tool comprises a plunger slidingly and sealingly disposed within a hollow sleeve. When the sleeve is held against a trigger point or otherwise affected area on the human body and the plunger is withdrawn, a negative or vacuum pressure of variable intensity and duration is created within the sleeve. When the plunger is depressed, the user can apply direct variable momentary pressure on the trigger point or otherwise affected area. Repeated cycles of direct momentary pressure and vacuum pressure help to resolve the soft tissue disorder and alleviate associated pain, which facilitates healing.

10 Claims, 2 Drawing Sheets

MASSAGE TOOL AND METHOD FOR TREATMENT OF TRIGGER POINTS AND OTHER SOFT TISSUE DISORDERS

FIELD OF THE INVENTION

The present invention relates generally to a massage tool. More particularly, the invention relates to a hand-held massage tool and its method of use in the application of varying positive pressure and varying negative pressure, or vacuum pressure, to specific soft tissue sites on the human body.

BACKGROUND OF THE INVENTION

Individuals who have had trauma or repetitive use injuries to their muscles can have stress and/or micro-tears to the muscle fibers that can lead to "trigger points" or other soft tissue disorders. Trigger points are hyper-irritable points that usually appear in the attachment sites and/or the belly of a muscle as small areas of tightness within muscles, creating tight bands and knots from the contracted muscle fibers. With palpation, a massage therapy practitioner, chiropractor, physician, or other practitioner can feel a hardening of the fascia/connective tissue at the site of the trigger point. When pressed, trigger points can produce pain both locally and in a referred manner, meaning that the pain can be felt elsewhere in the body. The hardening of the trigger point areas is thought to be the result of the soft tissue having been deprived of proper circulation. With tender points, another soft tissue disorder, the pain will be more localized.

As with all soft tissue disorders, the practitioner's goal is to recreate balance in the trigger point area by attempting to reestablish proper flow of circulation and to relax the injured area in order to elongate the soft tissue. This is usually done by deep manipulation of the soft tissue by positive physical pressure, generally, by the practitioner applying direct momentary pressure to the trigger point. During the treatment, the practitioner may return several times to a stubborn trigger point to elicit its release. The treatment can be quite painful to the recipient and also requires a high level of skill from the practitioner, often with limited results.

As would be the case when working tender points in fibromyalgia clients/patients, it would be desirable for practitioners to have a gentle and more effective means to combat the acute and chronic effects of the tender points. Fibromyalgia sufferers generally require stretching and a softer touch to restore blood flow and circulation and to resolve problems associated with tender points. It is therefore an object of the present invention to provide a tool for application of variable direct momentary positive pressure and also direct momentary negative pressure to the surfaces of the human body in an easy-to-use, hand-held device.

Further, trigger points can be difficult to manipulate directly because direct pressure can cause them to "move" from beneath the pressure source, e.g., a practitioner's hand or elbow. It would be desirable to have a means for containing the trigger points during application of direct momentary pressure. It is therefore an object of the invention to provide a device that bounds or contains trigger points or areas affected by soft tissue disorders while direct momentary positive and negative pressure is applied.

It is another object of the present invention to provide these capabilities in a simple and economical device.

SUMMARY OF THE INVENTION

The massage tool that is the subject of the present invention achieves these objectives by containing and treating trigger points and other soft tissue disorders by applying both direct manual pressure and negative vacuum pressure. Direct manual pressure is applied by positioning the sleeve of the tool over the affected area against the skin and depressing both the sleeve and tool's plunger, applying momentary direct pressure from the tool's pressure head. Then the plunger is pulled to create a vacuum on the containment area containing the area to be treated. Repeated cycles of pressure and vacuum are used to treat the problem area.

Containing a trigger point or other soft tissue disorder, i.e., keeping a trigger point directly underneath the direct manual pressure that is applied, is very difficult and often impossible manually. When using the positive and negative action of the tool, with the negative pressure creating a vacuum effect, the trigger point is placed in a more controlled position. The method of treatment using the massage tool differs from the method of "cupping," in which only negative pressure is applied that is long in duration and is not variable. The positive action of the tool allows the practitioner to apply varying levels of direct pressure to the trigger point without the trigger point moving away from the pressure. The variable negative action helps to loosen adhesions and lift the fascia/connective tissue, which helps to create circulation bringing blood flow back to compromised soft tissue. Both the positive and negative action of the tool elongates/stretches the soft tissue during treatment.

There are many possible uses for the tool according to the present invention. Some examples in addition to tender and trigger points are: gentle work with scar tissue, calcifications, bursitis, arthritis, sprains, and fibromyalgia. In these conditions, it is preferable not to use a hand-stroke method or use a device that may create undue pain, friction, or inflammation. This tool will allow a practitioner the ability to carefully manipulate the affected area with much more precision and control.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

These and other embodiments of the present invention will also become readily apparent to those skilled in the art from the following detailed description of the embodiments having reference to the attached figures, the invention not being limited to any particular embodiment(s) disclosed.

Figure 1:
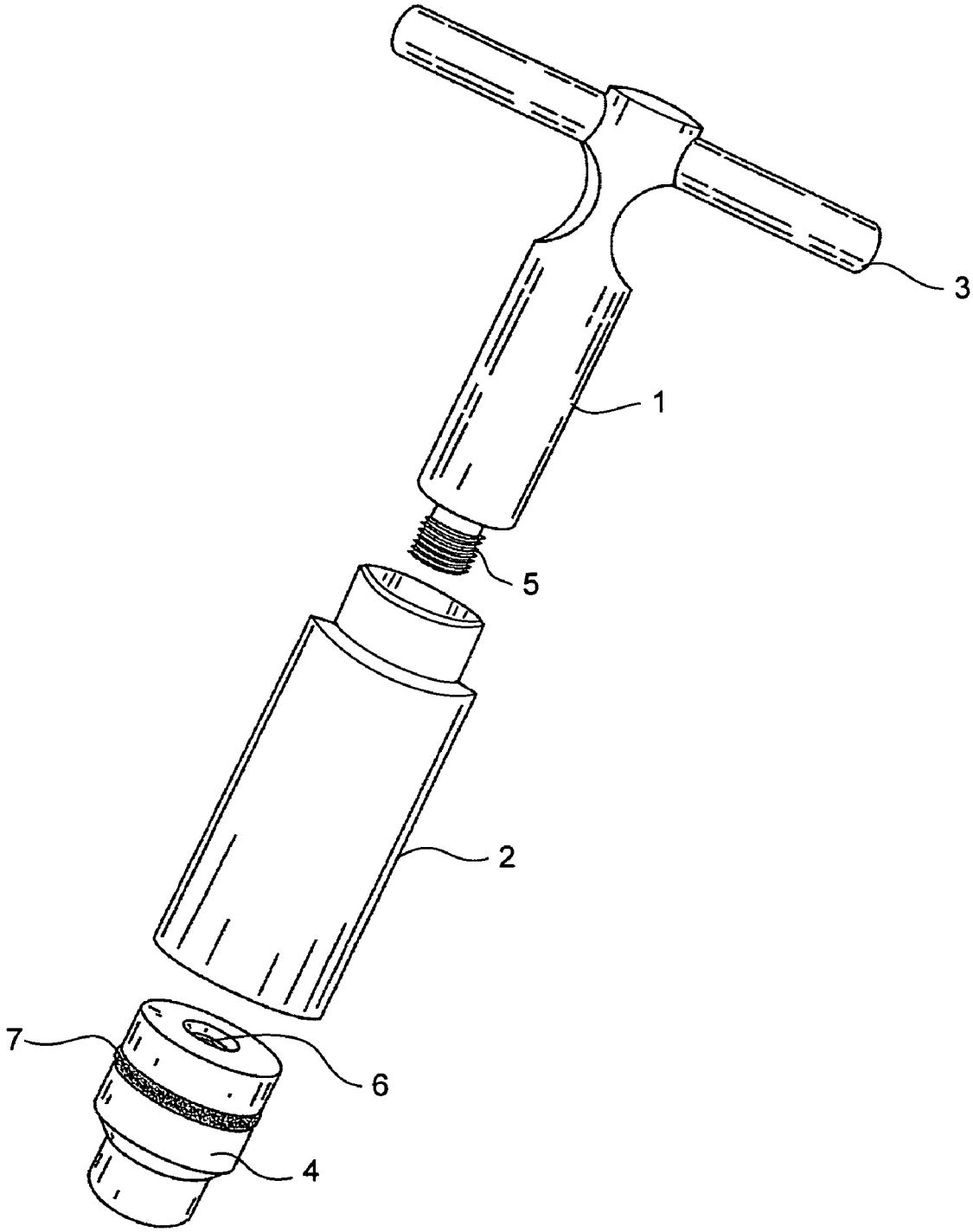
FIG. 1 is an exploded view of one embodiment of the massage tool.

Repeat use of reference characters throughout the present specification and appended drawings is intended to represent the same or analogous features or elements of the invention.

DETAILED DESCRIPTION

Figure 2:
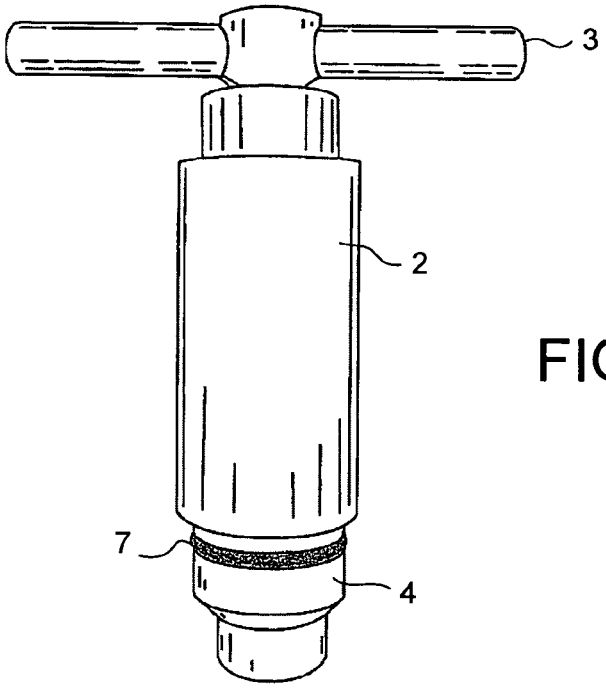
FIG. 2 is a perspective view of one embodiment of the massage tool in the fully depressed position.

FIG. 1 is an exploded view of the components of one embodiment of the massage tool, which consists generally of a plunger shaft 1 that fits within and slides within the vacuum sleeve 2. The plunger shaft 1 has a handle 3 that is used to pull and push the shaft 1 within the vacuum sleeve 2 to create the direct positive pressure and vacuum pressure desired. Pressure head 4 connects to shaft 1 and is the means for applying momentary direct pressure on the subject's skin. As can be seen in FIG. 2, when the plunger shaft is in the fully depressed position, the pressure head 4 protrudes from the opening of the sleeve 2.

Referring to FIG. 1, in the illustrated embodiment, the pressure head 4 is connected to the shaft 1 via male threads 5 on the shaft 1 mated with female threads in an opening 6 on the pressure head 4. In this embodiment, the shaft 1 is prevented from withdrawing fully from the sleeve by the "stepped" interior surface 8 of the sleeve 2.

Figure 3:
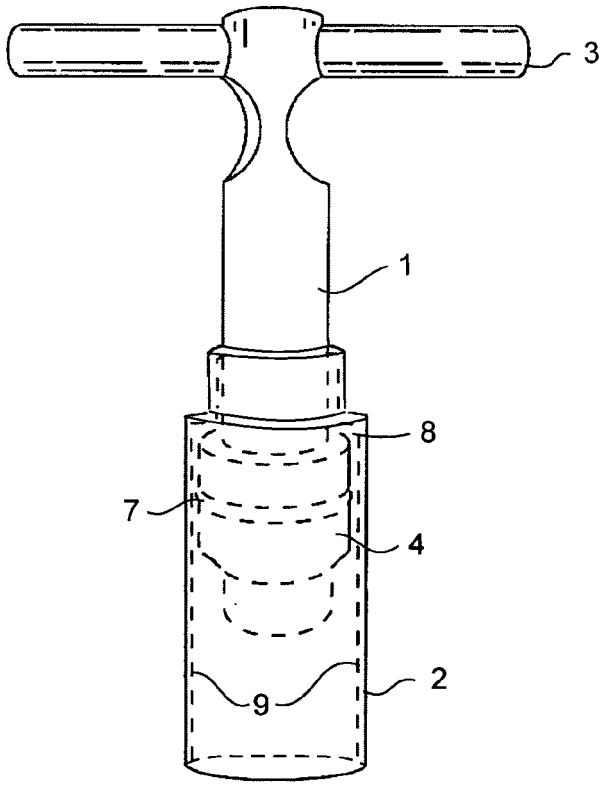
FIG. 3 is a perspective view of one embodiment of the massage tool in the fully retracted position.

In the illustrated embodiment of the invention, an elastomeric o-ring seal 7 on the pressure head 4 is used to create a seal against the inner walls (see item 9 of FIG. 3) of the vacuum sleeve 2 in order to pull and maintain a vacuum on the inside area of the vacuum sleeve when the plunger 1 is withdrawn. FIG. 3 illustrates this embodiment of the tool in the fully withdrawn position.

To operate the massage tool, the user grasps the vacuum sleeve 2 with one hand and grasps the plunger handle 3 with the other hand, and then places the bottom surface of the vacuum sleeve 2 against the skin of the human body. Downward pressure is applied with the vacuum sleeve during the entire treatment of a particular area. The user then pulls the plunger handle which moves shaft 1 within the vacuum sleeve 2 and creates a negative pressure inside the vacuum sleeve until the desired vacuum is pulled. Next, the user pushes the handle 3 to depress the shaft 1 such that the bottom surface of the pressure head 4 contacts the skin of the subject. The user then manually applies the desired level of momentary direct pressure with the pressure head for the desired amount of time. Then, the process is repeated by pulling the plunger and creating the desired amount of vacuum on the contained area of skin for the desired amount of time.

Although the illustrated embodiment depicts a cylindrical vacuum sleeve and shaft, other shapes—such as ovals or oblong shapes—are possible within the scope of the present invention. The only limitation to the shape of the vacuum sleeve and shaft is that the shaft must seal against and within the sleeve sufficiently to create the desired negative pressure. Further, the massage tool can be made in virtually any size, for application on small areas of the body or on larger areas. The massage tool may be fabricated from any number of materials including aluminum, stainless steel, composite, plastic, or glass.

In addition, although the illustrated embodiment is a hand-held and hand-operated device, other embodiments are possible that employ a motorized cycle of depression and suction to treat affected areas of the human body. Motorized embodiments may use straps to hold the tool in place or by having the subject lie on or against the massage tool.

This invention may be provided in other specific forms and embodiments without departing from the essential characteristics as described herein. The embodiments described are to be considered in all aspects as illustrative only and not restrictive in any manner. The following claims rather than the foregoing description indicate the scope of the invention.

What is claimed is:

1. A hand-held massage tool comprising:

a plunger comprising a skin contact end and a free end, the plunger being slidingly and sealingly disposed within a substantially hollow sleeve comprising a bottom end, the plunger comprising a pressure head, the pressure head being extendable beyond the bottom end of the tool and retractable within the hollow sleeve, whereby depression of the plunger causes the pressure head to extend beyond the bottom end of the hollow sleeve and directly contact a human body, and whereby retraction of the plunger while the bottom end of the hollow sleeve is in substantially complete contact with the human body causes negative pressure within the hollow sleeve.

2. The hand-held massage tool of claim 1, wherein the bottom end of the substantially hollow sleeve bounds and contains an area of skin under treatment.

3. The hand-held massage tool of claim 1, wherein the free end of the plunger comprises a grippable handle.

4. The hand-held massage tool of claim 1, wherein the plunger and the sleeve are substantially cylindrical in shape.

5. The hand-held massage tool of claim 1, wherein the plunger further comprises a means of making a substantially airtight seal against the sleeve.

6. The hand-held massage tool of claim 1, wherein the plunger further comprises an o-ring seal.

7. A hand-held massage tool comprising:

a substantially cylindrical plunger comprising a skin contact end and a free end, the free end comprising a grippable handle, and the plunger being slidingly and sealingly disposed within a substantially cylindrical and substantially hollow sleeve comprising a bottom end and a top end, the plunger comprising a pressure head, the pressure head being extendable beyond the bottom end of the sleeve and retractable within the hollow sleeve, whereby depression of the plunger causes the pressure head to extend beyond the bottom end of the tool and directly contact a human body, and whereby retraction of the plunger while the bottom end of the hollow sleeve is in substantially complete contact with the human body causes negative pressure within the hollow sleeve.

8. A method for the treatment of trigger points and other soft tissue disorders, comprising the steps of:

a. placing and holding a substantially hollow sleeve on an affected area in contact with the human body, whereby the sleeve is sealingly and slidingly connected to a plunger having a head;

b. withdrawing the plunger to create a negative pressure to the affected area within the sleeve;

c. depressing the plunger to cause the plunger's head to directly contact the affected area;

d. repeating steps a-c until the desired results are achieved.

9. The method of claim 8, wherein the negative pressure is variable and momentary.

10. The method of claim 8, wherein the direct pressure step of depressing the plunger contact is variable and momentary.

* * * * *